US005490887A

United States Patent [19]

Cranney et al.

[11] Patent Number: 5,490,887

[45] Date of Patent: Feb. 13, 1996

[54] LOW DENSITY WATERGEL EXPLOSIVE COMPOSITION

[75] Inventors: Don H. Cranney, South Jordan; Lawrence D. Lawrence, Sandy; Michael M. Jackson, Murray, all of Utah

[73] Assignee: Dyno Nobel Inc., Salt Lake City, Utah

[21] Appl. No.: 171,843

[22] Filed: Dec. 22, 1993

Related U.S. Application Data

[63] Continuation of Ser. No. 16,076, Feb. 10, 1993, abandoned, which is a continuation-in-part of Ser. No. 877,133, May 1, 1992, abandoned.

[51] Int. Cl.[6] ..... C06B 45/00; C06B 31/28

[52] U.S. Cl. ..... 149/2; 149/46

[58] Field of Search ..... 149/2, 46

[56] References Cited

U.S. PATENT DOCUMENTS

| | | | |
|---|---|---|---|
| 4,357,184 | 11/1982 | Binet et al. | 149/2 |
| 4,364,782 | 12/1982 | Funk et al. | 149/21 |
| 4,401,490 | 8/1983 | Alexander et al. | 149/2 |
| 4,547,234 | 10/1985 | Takeuchi et al. | 149/46 |
| 4,732,626 | 3/1988 | Edamura et al. | 149/21 |
| 4,737,207 | 4/1988 | Ehrnström et al. | 149/2 |
| 4,976,793 | 12/1990 | Zimmermann | 149/21 |
| 4,980,000 | 12/1990 | Sohara | 149/109.6 |
| 4,995,925 | 2/1991 | Engsbräten | 149/2 |
| 5,017,251 | 5/1991 | Lawrence et al. | 149/2 |
| 5,240,524 | 8/1993 | Chattopadhyay | 149/46 |
| 5,409,556 | 4/1995 | Lownds | 149/2 |
| 5,431,757 | 7/1995 | Petterson et al. | 149/46 |

OTHER PUBLICATIONS

*The Explosives Engineer*, "Hercules Energy Management System," Clyde W. Eilo, published by Hercules Incorporated, Wilmington, Delaware, 1968, No. 1, pp. 14–21.

"Only Slurrex" technical advertisement published by Hercules Incorporated in late 1960's.

*Primary Examiner*—Edward A. Miller

[57] ABSTRACT

The present invention comprises a watergel explosive composition, and method of manufacturing the same, that has a density of less than 0.8 g/cc. The composition has good water resistance and is especially useful in blasting applications calling for lower energy explosives.

10 Claims, No Drawings

LOW DENSITY WATERGEL EXPLOSIVE COMPOSITION

This application is a continuation of application Ser. No. 08/016,076, filed Feb. 10, 1993, abandoned, which is a continuation-in-part of application Ser. No. 07/877,133, filed May 1, 1992, abandoned.

Conventional water-based slurry or watergel explosives have been in use for about thirty years. See, for example, U.S. Pat. Nos. 3,249,474; 3,660,181 and 4,364,782. These explosives generally have a continuous aqueous phase of inorganic oxidizer salt dissolved in water, a fuel(s) dispersed or dissolved throughout the phase and thickening and crosslinking agents to impart desired rheology. The explosives also generally require a density reducing agent for imparting adequate detonation sensitivity. Such reducing agents are air bubbles, which can be entrained during mixing of ingredients, gas bubbles produced in-situ chemically, small, hollow, dispersed glass or plastic spheres and other porous, gas-entraining solids such as expanded perlite. The present invention relates to watergel explosive compositions of this general type. It more particularly relates to low density watergel explosive compositions having a density of less than 0.8 g/cc.

The most commonly used explosive is ANFO, which is a blend of ammonium nitrate (AN) prills and fuel oil or equivalent. ANFO suffers from the disadvantage, however, that it is not water-resistant and therefore can be used successfully only in dry boreholes, in boreholes that have been dewatered or lined with a water resistant liner or in packaged form in "wet" applications. These methods of using ANFO in wet applications require additional time and/or expense. Even in dewatered boreholes, water seepage with time can degrade the loaded ANFO due to dissolution of the AN.

ANFO has a relatively low density (from about 0.82 to about 0.9 g/cc) and thus is suited for applications requiring relatively low bulk explosive energy, such as for presplit applications and blasting of "soft" rock, coal or overburden. Even so, the explosive energy of ANFO may exceed that desired for certain "soft" blasting applications such as blasting of coal seams that ideally require less explosive energy than even that produced by ANFO. Such "soft" blasting operations also may be in wet boreholes that require dewatering.

Thus a need exists for a very low energy blasting composition that can be used in "soft" blasting applications and in borehole environments that can have some water present, such as in dewatered boreholes that experience seepage.

Watergel explosives satisfy one of these needs in that they generally are water-resistant due to their thickened, continuous aqueous phase. However, their densities generally are much higher than those even of ANFO, generally ranging from 0.9 to 1.6 g/cc and usually well above 1.0 g/cc. Australian patent no. 550930 discloses a "melt explosive composition" that can have a density as low as 0.3 g/cc for low energy applications, but these compositions are distinguished from "watergels" in that the melt compositions are "not diluted by an appreciable amount of water," and therefore have a higher energy per unit weight, and comprise a melt of oxidizer and fuel mixed with oiled ammonium nitrate prills.

The present invention comprises a watergel explosive composition, and method of manufacturing the same, that has a density of less than 0.8 g/cc and thus meets both of the described needs for water resistance and low energy. Another advantageous characteristic of these compositions for "soft" blasting operations is that they can have relatively low detonation velocities.

SUMMARY OF THE INVENTION

The invention comprises a low-density watergel explosive composition comprising a continuous phase of aqueous inorganic oxidizer salt solution, thickening and crosslinking agents, fuel and a density reducing agent in an amount sufficient to reduce the density of the composition to less than 0.8 g/cc. To this composition a significant quantity of ammonium nitrate particles, such as prills, can be added. The method comprises forming an aqueous inorganic oxidizer salt solution, prethickening the solution with a thickening agent, adding a fuel, dispersing a chemical gassing agent throughout the prethickened solution to form a fine, stable dispersion of gas bubbles in a volume sufficient to reduce the density to less than 0.8 g/cc and preferably crosslinking the thickened solution by addition of a crosslinking agent. A method further comprises adding ammonium nitrate particles to the prethickened solution.

DETAILED DESCRIPTION OF THE INVENTION

The inorganic oxidizer salt solution forming the continuous phase of the explosive generally comprises inorganic oxidizer salt in an amount of from about 30% to about 90% by weight of the total composition and water and/or water-miscible organic liquids in an amount of from about 10% to about 40%.

The oxidizer salts are selected from the group consisting of ammonium, alkali and alkaline earth metal nitrates, chlorates and perchlorates. The preferred oxidizer salt is ammonium nitrate (AN), but calcium nitrate (CN) and sodium nitrate (SN) or other oxidizer salts can be used. The total solubilized oxidizer salt employed is preferably from about 50% to about 86%. As is described below, ammonium nitrate in solid form or ANFO (AN prills and fuel oil) additionally can be added to the compositions.

The total amount of water and/or water-miscible liquid present in the composition is generally from about 10 to about 40% by weight. The use of water and/or water-miscible liquid in amounts within this range will generally allow the compositions to be fluid enough to be pumped by conventional slurry pumps at formulation or mixing temperatures, i.e., above the crystallization temperature (fudge point) of the composition. After pumping, precipitation of some of the dissolved oxidizer salt may occur upon cooling to temperatures below the fudge point, although repumpable formulations may experience little, if any, precipitation.

The fuel can be solid and/or liquid. Examples of solid fuels which can be used are aluminum particles and carbonaceous materials such as gilsonite or coal. Liquid or soluble fuels may include either water-miscible or immiscible organics. Miscible liquid or soluble fuels include alcohols such as methyl alcohol, glycols such as ethylene glycol, amides such as formamide, urea, and analogous nitrogen containing liquids. These fuels generally act as a solvent for the oxidizer salt or water extender and, therefore, can replace some or all of the water. Water-immiscible organic liquid fuels can be aliphatic, alicyclic, and/or aromatic and either saturated and/or unsaturated. For example, toluene and the xylenes can be employed. Aliphatic and aromatic nitro-compounds also can be used. Preferred fuels include mixtures of normally liquid hydrocarbons generally referred to as petroleum distillates such as gasoline, kerosene and diesel fuels. A particularly preferred liquid fuel is No. 2 fuel oil. Tall oil and paraffin oil also can be used. Mixtures of any of the above fuels can be used. As is described below, the water-immiscible organic liquid fuel can be combined with ammonium nitrate prills before it is added to the composition.

The fuel is present in an amount to provide an overall oxygen balance of from about −10 to about 0 percent. Fuel oil, when used, is normally used in amounts of from about 1% to about 8% by weight, preferably from about 3% to about 7%, and when used as the sole fuel, is preferably used in amounts of from about 4% to about 6% by weight.

The aqueous fluid phase of the composition is rendered viscous by the addition of one or more thickening agents of the type and in the amount commonly employed in the art. Such thickening agents include galactomannin, preferably guar, gums; guar gum of reduced molecular weight as described in U.S. Pat. No. 3,788,909, polyacrylamide and analogous synthetic thickeners, flours, and starches. Biopolymer gums, such as those described in U.S. Pat. No. 3,788,909 also can be used. Thickening agents generally are used in amounts ranging from about 0.2% to about 2.0%, but flours and starches may be employed in much greater amounts, up to about 10% in which case they also function importantly as fuels. Mixtures of thickening agents can be used.

The thickening agent preferably is used in an amount sufficient to prethicken the aqueous solution to a viscosity of at least 500 centipoise (Brookfield viscometer, Model HATD, No. 2 HA spindle at 100 rpm) prior to the addition of the density reducing agent as described below.

As is well known in the art, density reducing agents are employed to lower and control the density of and to impart sensitivity to watergel explosive compositions. The compositions of the present invention preferably employ a small amount, e.g., about 0.01% to about 0.2% or more, of a chemical gassing agent to obtain a composition density of less than 0.8 gm/cc. The compositions of the present invention preferably have a density of less than 0.7 g/cc and more preferably less than 0.6 g/cc. A preferred gassing agent is a nitrite salt such as sodium nitrite, which chemically reacts in the solution of the composition to produce gas bubbles. Other trace ingredients also can be added to enhance gassing rates or adjust pH. Mechanical agitation of the thickened aqueous phase of the composition, such as obtained during the mixing of the prethickened aqueous phase and the remaining ingredients, will result in the entrainment of fine air bubbles by mechanical means. Hollow particles such as hollow glass spheres, styrofoam beads, plastic microballoons and porous solids such as perlite also are commonly employed to produce a gassified explosive composition, particularly when incompressibility is desired. Two or more of these common density reducing means may be employed simultaneously.

A crosslinking agent preferably is employed in the compositions of the present invention. Crosslinking agents for crosslinking the thickening agents are well known in the art. Such agents usually are added in trace amounts and usually comprise metallic ions such as dichromate or antimony ions. The preferred crosslinking agent is antimony ion, preferably from potassium pyroantimonate, in an amount of from about 0.001% to about 0.1%.

To the basic composition described above, solid ammonium nitrate (AN) particles preferably are added in an amount of from about 10% to about 70% of the total composition. The form of such AN can be porous prills, dense prills or crystalline. If porous prills are used, the water-immiscible organic liquid fuel preferably can be added to the prills prior to adding the prills to the composition. This is the preferred manner of adding the water-immiscible organic liquid fuel to the composition, because when added separately it tends to fluidize the mixture and thus reduce its viscosity, thereby decreasing the ability of the aqueous phase to entrain air or hold gas bubbles.

The explosives are prepared by first forming a solution of the oxidizer salt and water (and miscible liquid fuel, if any) at a temperature above the fudge point or crystallization temperature of the solution. Typically, the explosives are prepared at a temperature of at least 10° C. above the fudge point. The thickening agent then is added to prethicken the solution to a desired degree, preferably to a viscosity of at least 500 centipoise (Brookfield viscometer). The density reducing agent, preferably a chemical gassing agent, then is added and dispersed throughout the prethickened solution to form a fine, stable dispersion of air or gas bubbles in a volume sufficient to reduce the density to the desired level. A crosslinking agent preferably then is added to crosslink the thickened solution and impart final desired rheology. Optionally, ammonium nitrate particles (which preferably contain water-immiscible organic liquid fuel) may be added to the prethickened solution and dispersed uniformly throughout the composition. Conventional metering, blending and mixing apparatus can be employed in the above steps, which can be performed in a continuous or batch process.

The invention can be further understood by reference to the following tables. All mixes in Table I were manufactured at a rate of about 45 kg/min in a high shear mixer. The ammonium nitrate solution was prethickened with guar gum and the gassing agent was injected into the prethickened oxidizer solution prior to the mixer. Following mixing, the crosslinking agent (potassium pyroantimonate) and the acetic acid for pH adjustment were added in a second mixer. In Examples 2–4 and 6–8, the AN prills also were added in the second mixer. The detonation results were as shown.

Table II shows a composition of the present invention that has been gassed to the extremely low density of 0.28 g/cc. Even at this very low density, the composition detonated in larger diameters unconfined and in a steel pipe of 100 millimeters internal diameter.

Table III shows a composition of the present invention that is repumpable, i.e., one that remains fluid enough to be transported from its place of manufacture to a storage or blasting site where it then is "repumped" from a transportation container into a borehole or storage container. The gassing and crosslinking agents generally are not added to the composition until just prior to delivery into a borehole.

The explosive compositions of the present invention can be used in a conventional manner. They can be plant-mixed to a desired degree of fluidity and then transported to a blasting site where they can be repumped into boreholes following the addition of gassing and crosslinking agents. They also can be mixed on-site in a site-mixed system or truck as is known in the art. Since their densities are below that for water, they generally are loaded into dry or dewatered boreholes. As previously indicated, the compositions are water-resistant and thus can be used effectively in boreholes that may have some water present, such as in dewatered boreholes that experience seepage. They also can be used in packaged form.

While the present invention has been described with reference to certain illustrative examples and preferred embodiments, various modifications will be apparent to those skilled in the art and any such modifications are intended to be within the scope of the invention as set forth in the appended claims.

TABLE I

| | 1 | 2 | 3 | 4 | 5 | 6 | 7 | 8 |
|---|---|---|---|---|---|---|---|---|
| AN (in solution) | 75.71 | 55.33 | 43.33 | 53.62 | 69.94 | 51.59 | 49.60 | 47.31 |
| $H_2O$ | 18.59 | 13.59 | 10.64 | 15.60 | 24.57 | 17.68 | 19.98 | 22.27 |
| Guar Gum | 0.34 | 0.25 | 0.20 | 0.42 | 0.62 | 0.45 | 0.28 | 0.28 |
| Fuel Oil | 4.65 | 5.00 | 5.00 | 4.58 | 4.05 | 4.46 | 4.34 | 4.34 |
| AN Prill | — | 25.00 | 40.00 | 25.00 | — | 25.00 | 25.00 | 25.00 |
| Crosslinking Agent | 0.05 | 0.05 | 0.05 | 0.07 | 0.07 | 0.07 | 0.05 | 0.05 |
| Gassing Agent* | 0.60 | 0.70 | 0.70 | 0.65 | 0.65 | 0.64 | 0.65 | 0.65 |
| Acetic Acid (60%) | 0.06 | 0.08 | 0.08 | 0.06 | 0.10 | 0.10 | 0.10 | 0.10 |
| Oxidizer Solutions | | | | | | | | |
| Fudge Point (°C.) | 60 | 60 | 60 | 50 | 40 | 40 | 30 | 20 |
| pH | 5.0 | 5.0 | 5.0 | 5.0 | 5.2 | 5.2 | 5.4 | 5.4 |
| Viscosity (centipoise) | 1000 | 1000 | 1000 | 1100 | 1150 | 1150 | 1090 | 1000 |
| Temperature (°C.) | 73 | 73 | 73 | 80 | 55 | 55 | 48 | 40 |
| Initial Density (g/cc) | 0.73 | 0.70 | 0.71 | 0.56 | 0.60 | 0.62 | 0.66 | 0.66 |
| Temperature (°C.) | 70 | 55 | 55 | 65 | 50 | 45 | 35 | 30 |
| Results at 5° C. (24 Hour Storage) | | | | | | | | |
| Density (g/cc) | 0.75 | 0.66 | 0.71 | 0.55 | 0.72 | 0.65 | 0.66 | 0.67 |
| Detonation Velocity (km/sec) | | | | | | | | |
| 75 mm | — | — | 1.0 | — | — | — | — | — |
| 100 mm | 2.8 | 2.4 | 2.2 | — | — | 2.3 | — | — |
| 125 mm | 2.9 | 2.7 | 2.5 | 2.3 | — | 2.6 | — | 2.4 |
| Minimum Booster, 125 mm, det/fail (g of pentolite) | 90 g/50 g | 50 g/18 g | 18 g/9 g | 340 g/— | — | 50 g/18 g | — | 340 g/— |
| Critical Diameter, det/fail (mm) | 100/75 | 100/75 | 100/75 | 125/100 | — | 100/75 | — | 125/100 |
| Results at 20° C. | | | | | | | | |
| Density (g/cc) | — | — | — | 0.55 | 0.72 | 0.65 | 0.66 | 0.67 |
| Detonation Velocity (km/sec) | | | | | | | | |
| 63 mm | — | — | — | 1.8 | 2.7 | 1.9 | — | — |
| 75 mm | — | — | — | 1.9 | 2.6 | 2.3 | 2.0 | 2.2 |
| 100 mm | — | — | — | 2.2 | 2.8 | — | 2.4 | 2.4 |
| 125 mm | — | — | — | 2.5 | 2.9 | — | 2.4 | — |
| 150 mm | — | — | — | — | — | — | — | — |

*10/30/60 sodium thiocyanate/sodium nitrite/water

TABLE II

| Formulation: | | |
|---|---|---|
| AN | 49.67 | Oxidizer Solution |
| $H_2O$ | 20.00 | Fudge Point: 30° C. |
| Guar gum | 0.29 | pH: 5.0–5.5 |
| AN Prill | 25.00 | Viscosity: 1100 cps |
| Fuel Oil | 4.34 | Temperature: 75° C. |
| Gassing agent | 0.60 | |
| Acetic acid (50%) | 0.05 | |
| Crosslinking agent | 0.05 | |
| Initial density: 0.28–0.5 g/cc | | |
| Results at 30° C. | | |
| Density (g/cc) 0.28 | | |
| Detonation velocity (km/sec) unconfined cardboard tubes - 340 g booster | | |
| 100 mm | | Failed |
| 125 mm | | Low order |
| 150 mm | | 1.7 Det |
| 292 mm | | 2.0 Det |
| Results at 5° C., 340 g booster | | |
| 100 mm (confined*) | | 2.3 Det |
| 150 mm (unconfined) | | Low order |
| D (km/sec) Two week storage results at 5° C. | | |
| 125 mm (confined*) | | 2.3 Det |

*Schedule 40 steel pipe

TABLE III

| Formulation: | |
|---|---|
| AN (in solution) | 30.00 |
| Urea | 10.00 |
| $H_2O$ | 17.73 |
| Guar gum | 0.60 |
| ANFO (Premixed, 94/6) | 40.00 |
| Crosslinking agent | 0.07 |
| Gassing agent | 1.00 (10/30/60, $NaSCN/NaNO_2/H_2O$) |
| Acetic acid (60%) | 0.6 |
| Oxidizer solution | |
| Fudge point (°C.) | ~0 |
| pH | 4.5 |
| Viscosity (Cps) | ~5000 |
| Temp | ~20° C. |
| Results at 20° C.: | |
| Density (g/cc) | 0.55 |
| D (m/sec) | |
| 100 mm | 1550 |
| 125 mm | 2230 |
| 150 mm | 2350 |
| Minimum booster, 150 mm, det/fail (At 5° C. 150 mm fails) | 90 g/50 g |

What is claimed is:

1. A low-density water-gel explosive composition consisting essentially of a continuous phase of aqueous inorganic oxidizer salt solution in which water is present in an amount of from about 10% to about 40% of the composition, ammonium nitrate particles in an amount of from about 10% to about 70% of the composition, a thickening agent, a crosslinking agent, fuel selected from the group consisting of water-miscible fuels, water-immiscible organic liquid fuels and mixtures thereof and a dispersion of chemically produced gas bubbles in an amount sufficient to reduce the density of the composition to less than 0.7 g/cc.

2. A composition according to claim 1 wherein the aqueous inorganic oxidizer salt solution consists essentially of water and inorganic oxidizer salt selected from the group consisting of ammonium and alkali metal nitrates and perchlorates and alkaline earth metal nitrates and perchlorates.

3. A composition according to claim 2 wherein the inorganic oxidizer salt is predominantly ammonium nitrate.

4. A composition according to claim 3 wherein the ammonium nitrate oxidizer salt is the sole oxidizer salt used.

5. A composition according to claim 1 wherein the thickening agent is a guar gum.

6. A composition according to claim 1 wherein the crosslinking agent is an antimony ion.

7. A composition according to claim 6 wherein the crosslinking agent is potassium pyroantimonate.

8. A composition according to claim 1 wherein the organic liquid is No. 2 fuel oil.

9. A composition according to claim 1 wherein the water-miscible fuel is selected from the group consisting of alcohols and amides.

10. A low-density water-gel explosive composition consisting essentially of a continuous phase of aqueous inorganic oxidizer salt solution further consisting essentially of water in an amount of from about 10% to about 40% by weight of the composition and ammonium nitrate in an amount of from about 30% to about 90%, crosslinking agent in an amount of from about 0.001% to about 0.1%, guar gum in an amount of from about 0.2% to about 2%, fuel including water-immiscible organic liquid fuel in an amount of from 0% to about 6% and chemically produced gas bubbles dispersed throughout the composition in a volume sufficient to reduce the density of the composition to less than 0.7 g/cc.

* * * * *